United States Patent [19]

Young

[11] Patent Number: 5,054,464

[45] Date of Patent: Oct. 8, 1991

[54] RAPID FIRE GAS POWERED PROJECTILE GUN

[76] Inventor: William G. Young, 2034 Arnold Acres Dr., Pittsburgh, Pa. 15205

[21] Appl. No.: 83,633

[22] Filed: Aug. 7, 1987

[51] Int. Cl.[5] ..... F41B 11/2; F41B 11/6

[52] U.S. Cl. ..... 124/72; 124/74; 124/76; 124/53

[58] Field of Search ..... 124/72, 74, 73, 71, 124/51 R, 51 A, 53, 45, 83, 76, 52, 50, 49, 82; 403/349

[56] References Cited

U.S. PATENT DOCUMENTS

| | | | |
|---|---|---|---|
| 2,818,056 | 12/1957 | Martin | 124/72 |
| 2,820,655 | 1/1958 | Hileman | 403/349 |
| 2,940,438 | 6/1960 | Merz | 124/76 |
| 3,103,212 | 9/1963 | Merz | 124/74 X |
| 3,119,384 | 1/1964 | Merz | 124/51 R X |
| 3,177,863 | 4/1965 | Spack | 124/76 |
| 3,227,148 | 1/1966 | Spack | 124/53 X |
| 3,233,600 | 2/1966 | Spack | 124/76 X |
| 3,824,981 | 7/1974 | Crane et al. | 124/74 X |
| 3,996,916 | 12/1976 | Koehn et al. | 124/72 |
| 4,116,193 | 9/1978 | Chiba | 124/72 |
| 4,191,158 | 3/1980 | Curran | 124/74 X |
| 4,674,470 | 6/1987 | Tsukiji | 124/50 X |

*Primary Examiner*—Peter M. Cuomo

*Attorney, Agent, or Firm*—Reed Smith Shaw & McClay

[57] ABSTRACT

A rapid fire gas powered projectile gun is comprised of a projectile holder; a barrel connected to the projectile holder having a diameter smaller than the diameter of the projectile holder but at least as large as the diameter of a projectile to be fired, so the projectile to be fired stops before the barrel because of its smaller diameter but is able to pass out of the barrel when pressure is applied to the projectiles; a pressurization device connected to the projectile holder with the pressurization device fluidically connected to the projectile holder; a device for activating the pressurization device; a device for biasing located within the projectile holder and forcing any projectile in the projectile holder to be moved toward the barrel; and a trigger connected to the pressurization device in such a way that when the trigger is pulled pressure passes into the projectile holder forcing the projectiles out of the barrel.

12 Claims, 8 Drawing Sheets

RAPID FIRE GAS POWERED PROJECTILE GUN

FIELD OF THE INVENTION

The present invention relates to gas powered pellet guns. More specifically, the present invention relates to gas powered pellet guns which are rapid fire.

BACKGROUND OF THE INVENTION

For many years, air and gas guns were single shot models where one pellet at a time is loaded, the gun cocked and then fired. This process is repeated every time the gun is shot. One problem with a gun of this type is the difficulty in firing subsequent shots rapidly.

In attempting to overcome this problem various devices have been tried. A partial solution to this problem was the development of a spring loaded magazine. Crossman's Model 118 which uses such a magazine is bolt and cam operated. In other words, when the bolt is operated a swinging cam maneuvers a pellet into shooting position. Nevertheless, it is necessary to operate the bolt in order to fire a following shot. Another attempt at increasing a pellet gun's rate of fire can be found on the El Gamo Gamatic Repeater. However the gun must still be cocked to enable a carrier block to transfer the pellet to the air channel.

A pressurized gas or air operated repeater rifle is described in U.S. Pat. No. 4,116,193. This rifle's mechanism allows the loading of one pellet from the magazine, although a reciprocating motion of an operation lever is necessary to facilitate the movement of a carrier, and each shot requires the trigger to be pulled.

A rapid fire, fluid actuated BB gun is disclosed in U.S. Pat. No. 4,083,349 to Clifford. This gun is capable of automatic firing, but can only use round BB's and not soft lead pelletts shaped somewhat like an hour glass and hollow at their base. The BB's are stored in a magazine in a random fashion and are highly susceptible to jamming. When pressurized gas enters the chamber holding the BB's, as many BB's as can swirl into a stand pipe are swept from the bottom and fired. This results in jamming or erratic firing patterns.

Lately, a semi-automatic gas repeater has been manufactured, Daisy's Model 92, which operates by pulling the trigger. These do not need to be cocked, but still use a carrier block to transfer the pellet from the magazine to the air channel. Each shot though, still requires the trigger to be pulled.

SUMMARY OF THE INVENTION

The present invention pertains to a rapid fire gas operated gun for shooting projectiles. The invention comprises: means for holding projectiles; a barrel connected to the projectile holding means having a diameter smaller than the diameter of the projectile holding means but at least as large as the diameter of the projectile to be fired, so the projectiles to be fired stop before the barrel because of its smaller diameter but are able to pass out of the barrel when pressure is applied to the projectiles; means adapted for pressurization fluidically connected to the projectile holding means; means for biasing, said biasing means located within said holding means and forcing the projectiles in the holding means toward the barrel; and a trigger connected to the means adapted for pressurization in such a way that when the trigger is pulled pressure is capable of passing into the projectile holding means forcing the projectiles out of the barrel.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
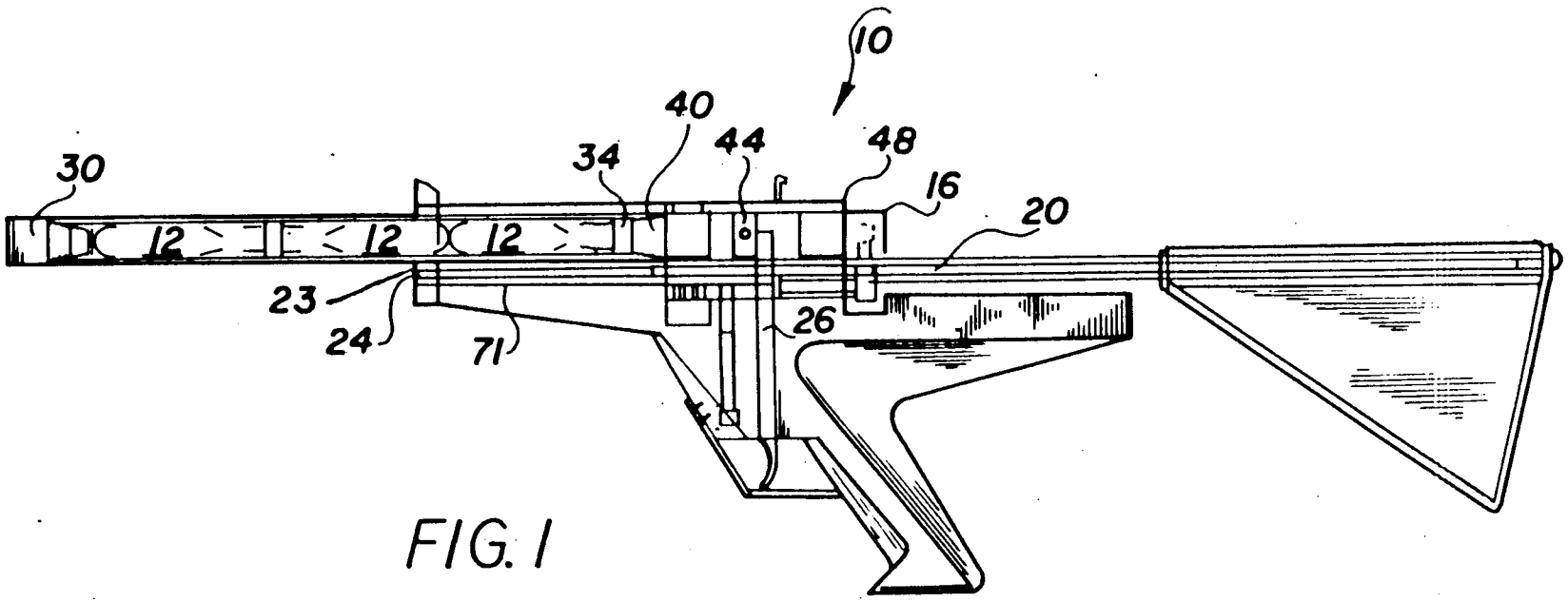
FIG. 1 is a cross-sectional view of the rapid fire gas powered pellet gun.

Referring now to the drawings, wherein like reference numerals designate identical or corresponding parts throughout the several views, and more particularly to FIG. 1 thereof, there is shown a rapid fire gas powered projectile gun 10. The gun 10 is powered by $CO_2$ cartridges 12 located in means adapted for pressurization such as a gas chamber tube 14. The $CO_2$ cartridges 12 release the pressurized $CO_2$ when means for activation including for instance a piercing knob 16 is struck causing means for piercing the cartridge such as cartridge piercers 18 which is also part of the activation means to penetrate and compromise the integrity of the cartridges 12. Projectiles 19 that are to be fired are stored in means for holding projectiles, for example a magazine 20 that has means for biasing, such as a spring 22. The spring 22 maintains a constant force on the projectiles 19 loaded in the magazine 20, pushing them forward to a barrel 24. The magazine 20 and barrel 24 together can be formed out of a common tubular member 71. When a trigger 26 is depressed, pressure in the chamber tube 14 flows down a gas port 28 fluidically connecting the chamber tube 14 and the magazine 20. The released pressure from the chamber tube 14 forces the projectile 19 that is positioned before the barrel 24 into, through and out of the barrel 24. The spring pushes the projectile 19 remaining in the magazine 20 forward into the space created by the firing of the projectile 19 immediately before the barrel. This allows the next projectile 19 that moves up to take the place of the previously fired projectile to be fired in the same manner. The projectiles 19 in the magazine 20, in this way are continually fired as long as the trigger 26 is depressed and there is pressure in the chamber tube 14.

Figure 2:
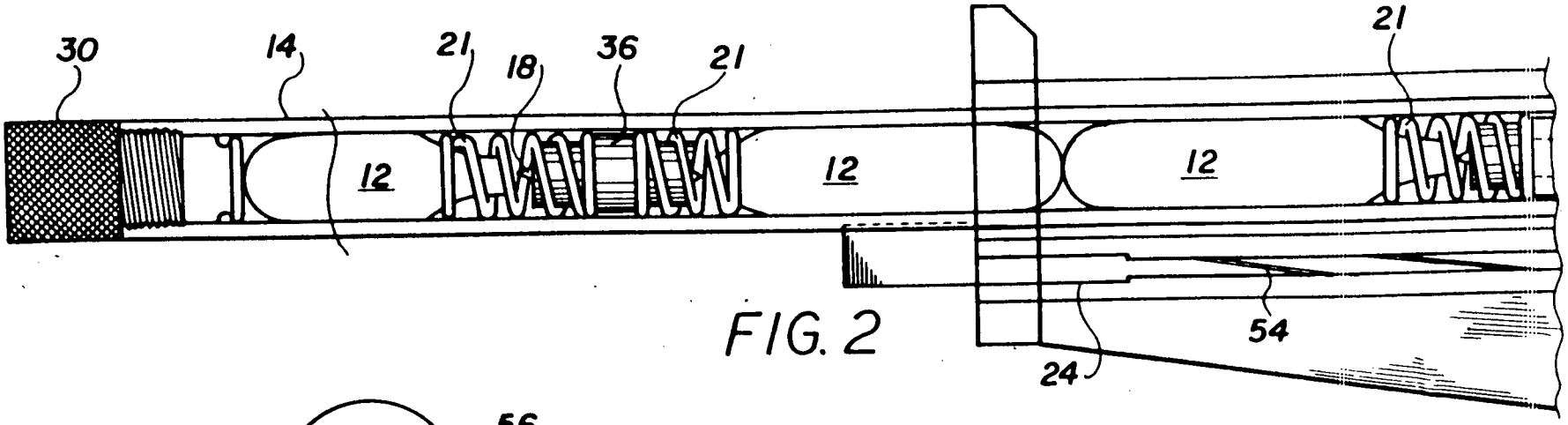
FIG. 2 is a cross-sectional view of the gas chamber tube.
Figure 3:
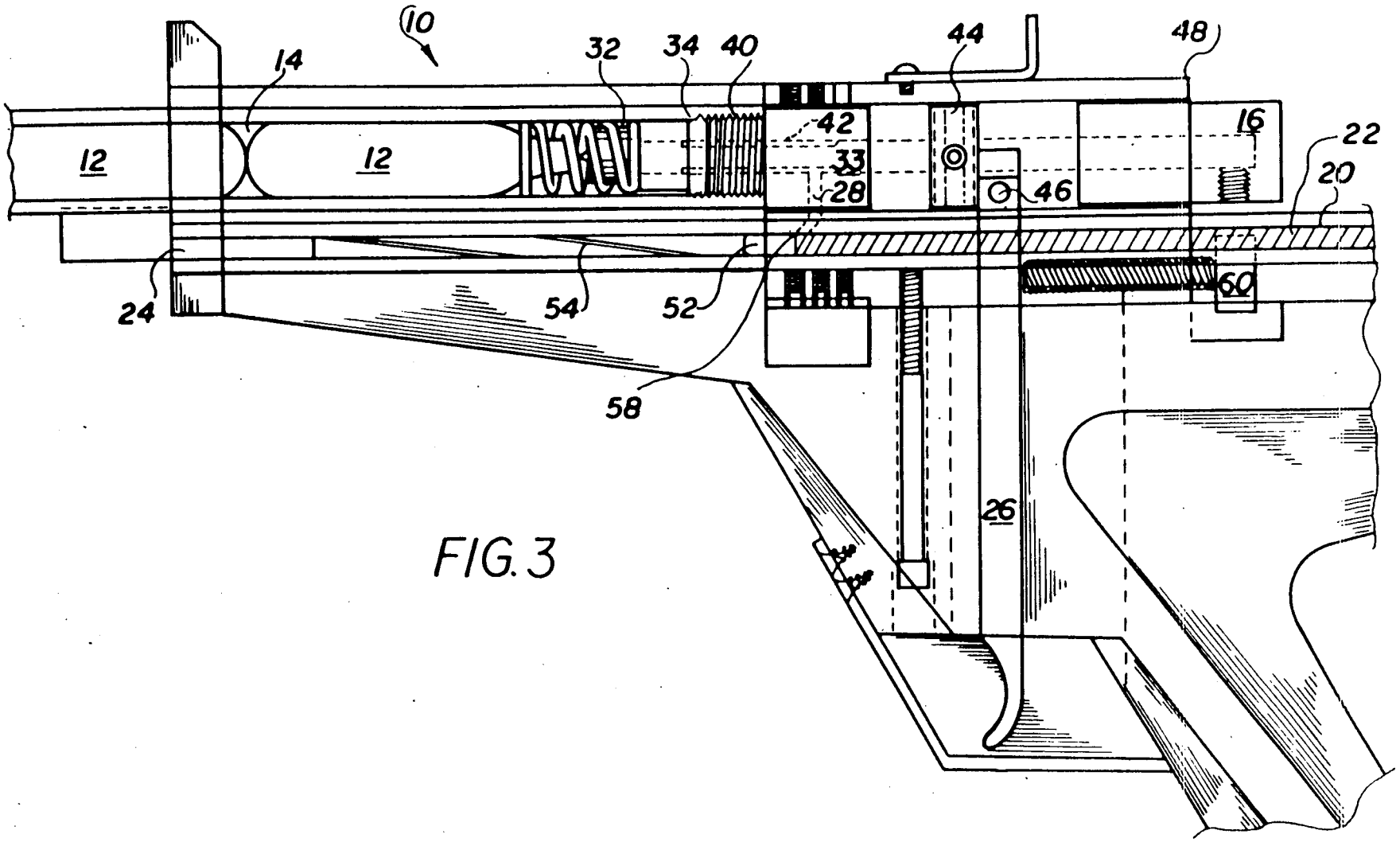
FIG. 3 is a cross-sectional view of the frame.

More specifically, and referring to FIGS. 2 and 3, by screwing in a gas chamber cap 30 mechanical pressure is applied to the springs 21 inside the gas chamber tube 14, causing them to become primed. With $CO_2$ cartridges in place the mechanical pressure is transferred through the tube 14 to a valve plunger and piercer 32. Behind the valve plunger 32, a round synthetic seal 34 with a hole in the middle prevents pressurized gas in the tube 14 from escaping through the valve 40.

The center pierce bushing 36 and valve plunger and piercer 32 enables there to be placed, pierced and utilized the gas power of one, two, three, four or more $CO_2$ cartridges 12. In a preferred embodiment, three $CO_2$ cartridges 12 are used. By adding length to the chamber tube 14 and adding another pierce bushing 36, one could construct a gun 10 that operates on five gas cartridges 12 or four by using one empty cartridge 12. The $CO_2$ cartridges are opened or pierced by striking with, for example, the heel of the hand against the piercing knob 16 or by hitting the piercing knob 16 against a hard object, such as a tree, table, etc. By applying this force to the piercing knob 16, springs 21 inside the gas chamber tube 14 are collapsed allowing $CO_2$ cartridges 12 to come in contact with the cartridge piercers 18. This action pierces the $CO_2$ cartridges. As soon as the cartridges 12 are pierced, gas is released into the chamber tube 14. The gas, along with the spring pressure, forces the valve plunger 32 back to the valve seal ring 34, thus stopping the gas from escaping past the valve. In order for all the $CO_2$ cartridges 12 to be pierced when the piercing knob 16 is struck and to keep gas from escaping past the valve, the springs 21 preferably are about 1 and $\frac{3}{8}$ inches long, are made of about 3/32 round wire and have an outside diameter of about 15/32 inch. They require at least 35 pounds of force to be fully compressed, and 12 pounds of force to be compressed to about one inch long.

When the valve push rod 33 is moved forward, it pushes the valve plunger and piercer 32 forward. This releases pressure from the valve seal ring 34 and allows gas to flow around pointed rings 38 that are turned on the valve plunger 32 and the gas valve 40.

The valve push rod 33 has four flat area 42 milled or ground on an area just past the valve port hole 28. These flats 42 allow gas to travel along the push rod 33 and out the valve port hole 28. The area on the push rod, 33 which is not milled flat blocks the gas flow by being round since the valve push rod 33 hole is round and sealingly fits with the valve 40.

The mechanism above is operated by means of a trigger 26 and a push rod washer 44. The trigger 26 is held in place by means of a dowel pin 46 through it and the frame 48. When the trigger 26 is pulled, a lever action takes place with the dowel pin 46 acting as the fulcrum. As the trigger 26 is pulled back, the top is forced forward, pushing the push rod washer 44, which is fastened to the valve push rod 33 forward. This action pushes the valve plunger forward, releasing pressure from the valve seal ring 34, allowing gas to enter the valve 40 and exit through the gas port hole 28. The relatively long length of the trigger 26 is necessary in view of the force needed to push the valve plunger 32 forward against the relatively great pressure in the chamber tube 14.

The embodiment illustrated above is of a type which is muzzle loaded. Other methods of loading, and in particular rear loading of the magazine 20 are discussed below.

In the operation of the invention by placing one, two, three or more pellets, darts, etc. in the barrel and by using a ramrod 23, the projectiles 19 are pushed down through the barrel 24 and into the magazine 20, which is reamed out wider than the magazine.

Figure 4:
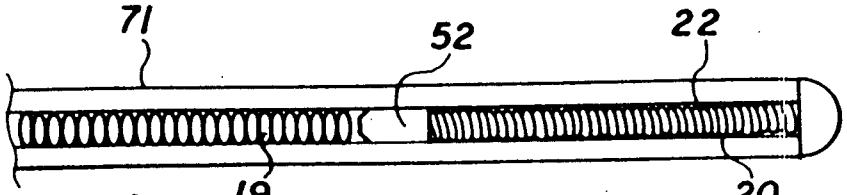
FIG. 4 is a cross-sectional view of the magazine barrel arrangement.

Inside the magazine 20 are a gas check valve 52, and spring 22. (See FIG. 4). Projectiles 19 come in contact with the gas check valve 52 when pushed through the barrel 24 with the ramrod. The length of the magazine 20 determines the amount of projectiles 19 one may load. By pushing projectiles 19 through the barrel 24, the gas check valve 52 is pushed backward. When the spring 22 is fully collapsed, the gun 10 is fully loaded. The projectiles 19 are kept from being pushed out the barrel 24 by the collapsed spring 22 because the spring 22 is not powerful enough to push them past the rifling 54 in the barrel area. Once the $CO_2$ cartridges 12 have been pierced by striking the piercing knob 16, the gun 10 is ready to shoot.

Figure 5:
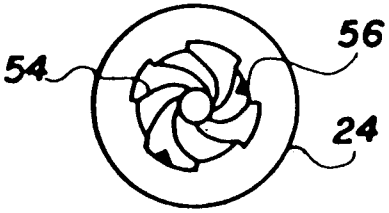
FIG. 5 is a back end view of the barrel.

Another way to keep projectiles 19 from being pushed back out the barrel 24 by the magazine spring 22 is to place points 56 protruding from inside the barrel area where rifling 54 starts (see FIG. 5). This is easily done for instance by placing a drill with an extension and hitting the extension with a hammer. This action is enough to produce the small protrusions 56 inside the barrel 24. However, with proper size barrels 24 this is not necessary.

The manner in which the projectiles 19 are shot is as follows. Inside the barrel 24 magazine 20 combination, just before the rifling 54 in the barrel 24, is a magazine port hole 58 milled or drilled, preferably at an angle, through the magazine 20 wall. When the trigger 26 is pulled, gas escaping from the valve 40 travels through a gas port 28 of the frame 48, then down through the gas port hole 58 in the magazine 20. Projectiles 19 that are forward of the gas port hole 58 in the magazine 20 are thus shot out the front of the barrel 24. New projectiles 19 take the place of the ones shot out the barrel 24 by action of the spring 22 behind the gas check valve 52 in the magazine 20. Preferably, the magazine port hole 58 enters the magazine 20 wall at a distance about the length of a projectile 19 to be fired from the barrel 24 so released pressure traveling through the gas port 58 will operate on only one projectile 19 at a time. By operating on only one projectile 19 at a time, the force from the released pressure is maximized on each projectile fired.

Figure 6:
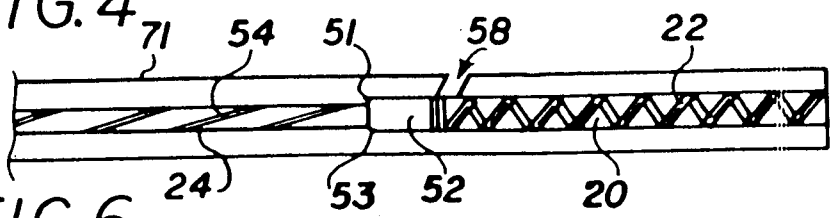
FIG. 6 is a cross-sectional view of the magazine-barrel interface.

When the last projectile 19 in the magazine 20 has been shot out or when the gas check valve 52 travels past the gas port hole 58 in the magazine 20, the gas check valve hits the rifling 54 and greatly reduces the amount of gas escaping out of the barrel 24. This is accomplished because the angle 51 on the gas check valve 52 is also the same angle 53 inside the barrel 24 where rifling 54 starts (see FIG. 6). Thus, when the magazine 20 is empty of projectiles 19 the gun 10 reduces the amount of gas flowing out of the barrel 24 even though the trigger 26 is pulled.

By fabricating a gas check valve 52 out of a hard synthetic material or by attaching a hard rubber like material to the front of the gas check valve an airtight seal is created were the gas check valve meets the rifling 54. this will completely stop gas grom escaping out of the barrel 24 when the trigger is pulled.

By unscrewing the trigger adjustment screw 60 the amount of trigger 26 travel can be increased (see FIG. 3). This increases the gap between the valve plunger 32, valve seal ring 34 and the gas valve 40 by its lever action acting on the push rod washer 44. By screwing the trigger adjustment screw 60 in to a point where the action cannot move the push rod washer 44, a point is reached where the trigger 26 will not pull back, thus creating a situation where the gun 10 will not shoot if the trigger is pulled, even if loaded with $CO_2$ and projectiles 19. This is the trigger's safe position. By unscrewing the safety 60 up to a certain point, the amount of pressure through the system is correspondingly increased, after which the pressure essentially stays fixed even though the safety is further unscrewed.

Figure 7:
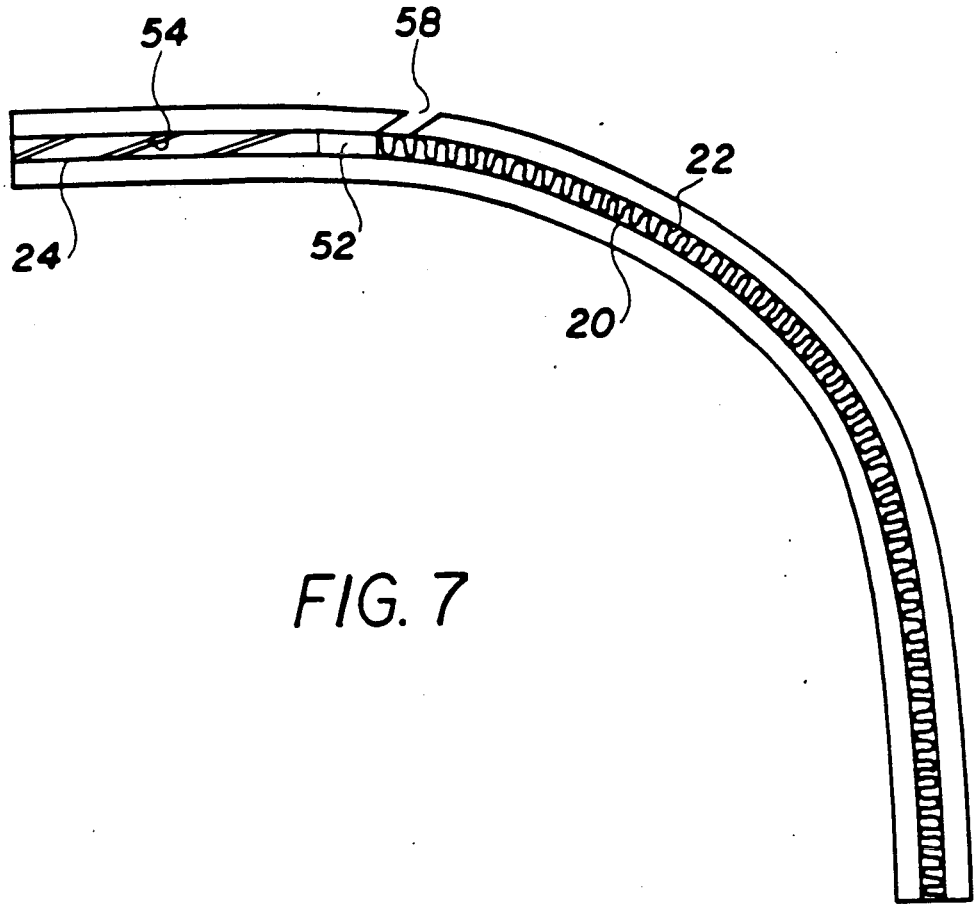
FIG. 7 is a cross-sectional view of a curved magazine.

One aspect of this gun's success against jamming lies with the in line barrel magazine arrangement typically formed from a tubular member. For example, by taking a 22 caliber rimfire barrel and reaming out a desired length, a small amount past the gas port hole 58, and by adding a spring 22 into the barrel 24, the gun is able to shoot in machine gun fashion. Additionally, if the magazine 20 is bent this principle will also work; in other words, the magazine does not have to be perfectly straight (see FIG. 7).

To fashion a gun 10 that loads from the rear and without a ramrod 23 is accomplished in many ways. A common feature though requires any design to be airtight. To make a magazine 20 that is rear loading (see FIGS. 8, 8*a*, 8B, 9, 9A and 9B), a magazine 20 is fashioned with a slot 62 along its length. A pin 64 is placed into an elongated check valve 52. An area in the rear of the magazine 20 has a check valve notch 68 into which the pin 64 locks. By pulling the pin 64 back along the slot 62, the spring 22 collapses and by placing the pin 64 in the notch 68, the spring 22 does not return. If another notch or pellet loading hole 70 is placed in front of the gas check valve 52 at its fully compressed location which is large enough to place a projectile through, it is possible to load the magazine 20 from the rear of the gun 10. By releasing the pin 64 from its hold position notch, pressure from the spring is applied.

Figure 8B:
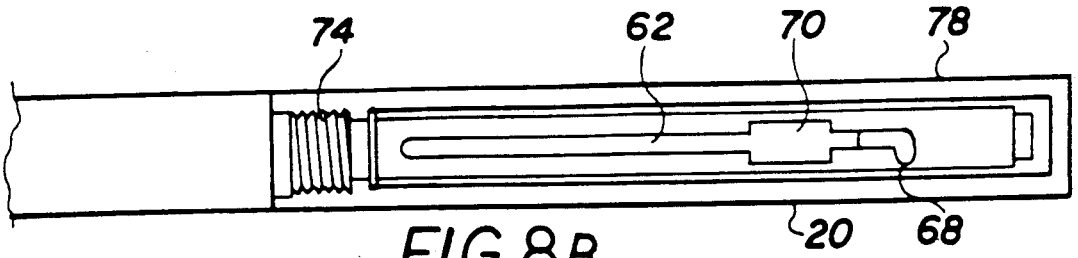
FIG. 8B is a cross-sectional view of the assembled rear loading magazine as shown disassembled in FIGS. 8 and 8A.
Figure 9B:
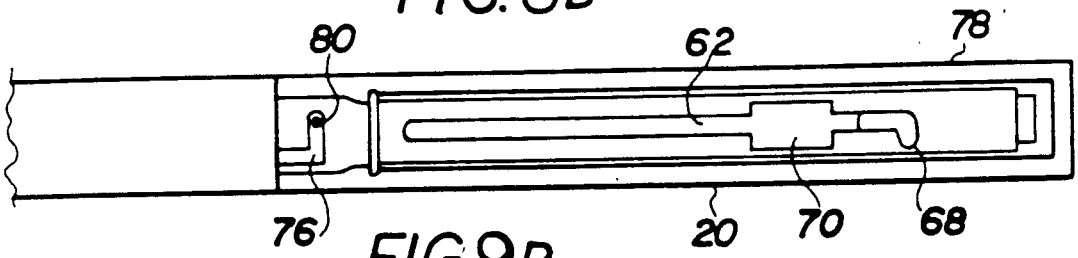
FIG. 9B is a cross-sectional view of the assembled rear loading magazine as shown disassembled in FIGS. 9 and 9A.
Figure 8:
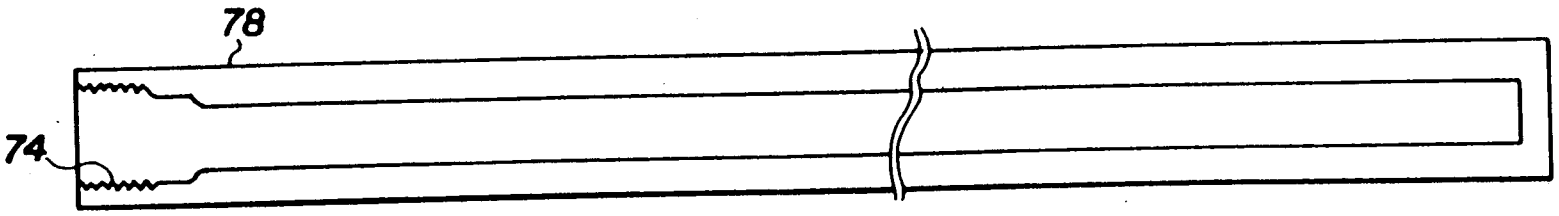
FIG. 8 is a cross-sectional view of a rear loading mechanism housing.
Figure 8A:
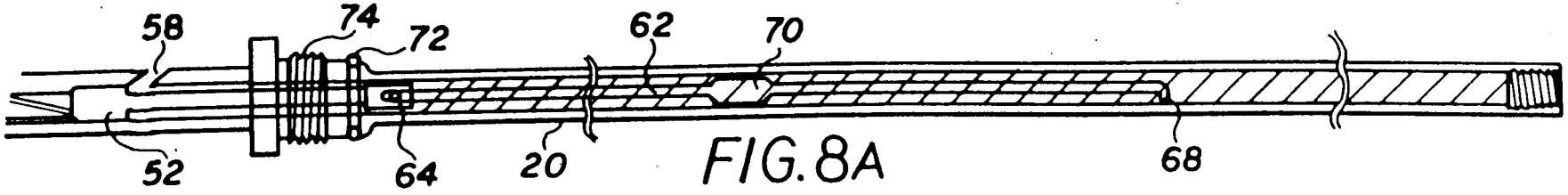
FIG. 8A is a cross-sectional view of an internal mechanism of the rear loading magazine.
Figure 9:
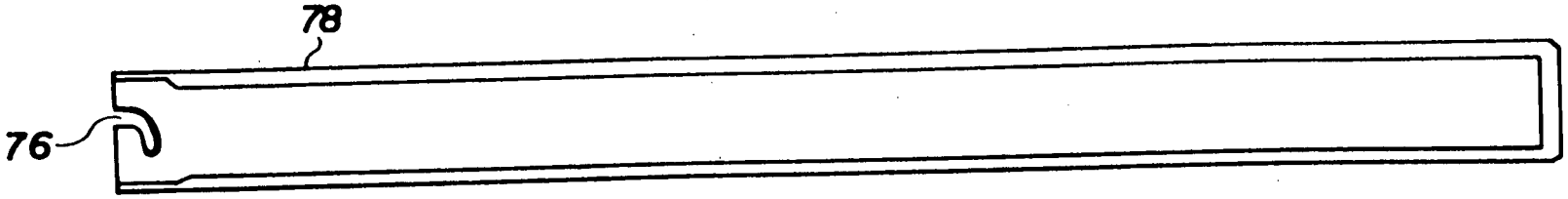
FIG. 9 is a cross-sectional view of a rear loading mechanism housing.
Figure 9A:
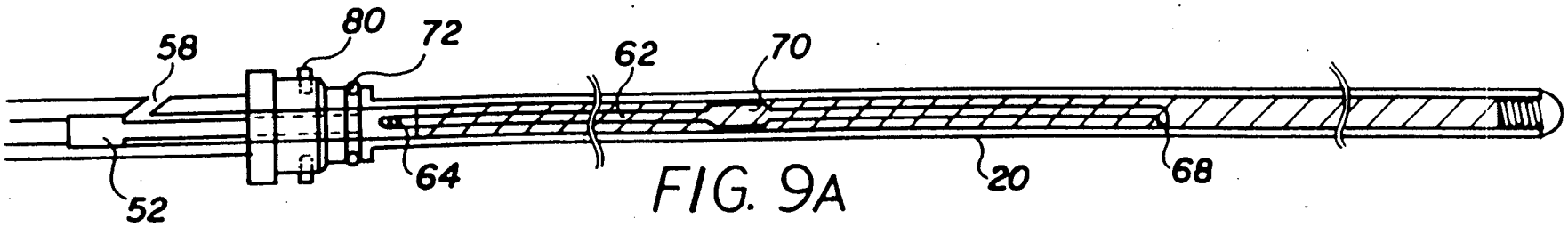
FIG. 9A is a cross-sectional view of an internal mechanism of the rear loading magazine.

Once this is done, the magazine 20 has to be covered and made airtight. This can be preferably accomplished with an O-ring 72 and threads 74 in housing 78, FIG. 8, or an O-ring 72 and pins 80, and grab notch 76 in housing 78 (FIGS. 9A and 9B). It is essential that the magazine 20 be airtight. Even a very minor leak will adversely effect the velocity of the projectile 19, and if the leak is too great, the gun 10 will not shoot. FIGS. 8A and 9A show the magazine 20 - housing 78 apart for the threads 74 or notch 76 embodiments, respectively, and FIGS. 8B and 9B show the magazines 20 - housing 78 together for the threads 74 or notch 76 embodiments, respectively.

Figure 10:
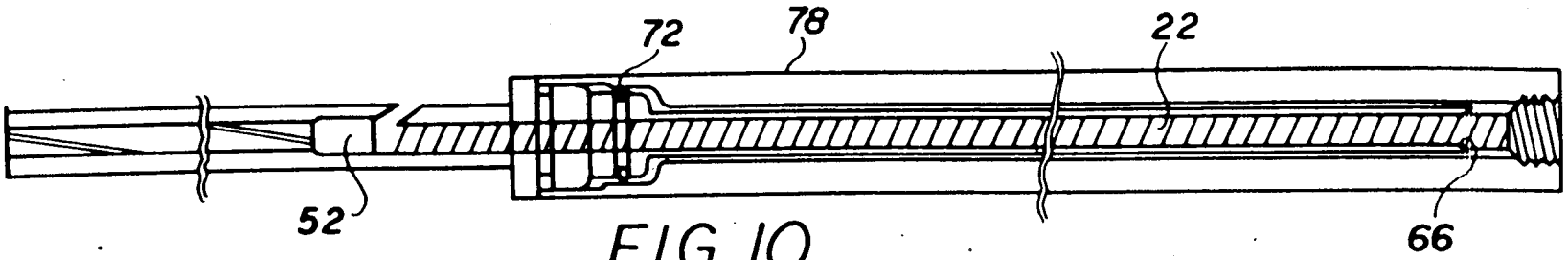
FIG. 10 is a cross-sectional view of a rear loading magazine.
Figure 10A:
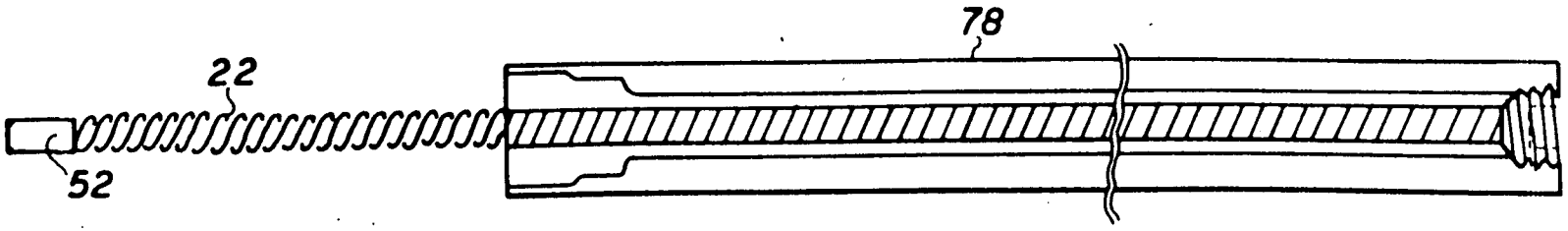
FIG. 10A is a cross-sectional view of a rear loading magazine.

Another rear loading magazine 20 is shown in FIG. 10 and 10*a*. In this embodiment, the projectiles are loaded into the magazine through a rear hole 66. The housing 78 with the fixedly attached spring 22 is then placed over the magazine 20 with the gas check valve 52' inserted into the rear hole 66 and pushed forward along with the spring 22 attached thereto. The securing mechanism is the same as described above for the other two rear-loading embodiments.

Figure 11:
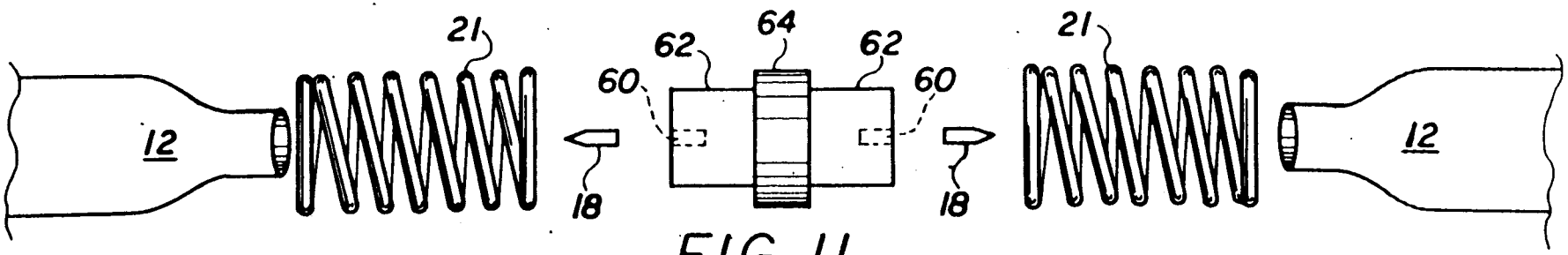
FIG. 11 is a cross-sectional view of the center pierce bushing assembly.

The center pierce bushing 36 and valve plunger and piercer 32 operate in the following manner. Preferably, three springs 21 are placed on smaller diameter areas of the center pierce bushing 36 and valve plunger and piercer 32 and fastened with a press fit. When the piercing knob 16 in the rear of the frame 48 is pushed forward, the springs 21 collapse. When a $CO_2$ cartridge 12 seal comes in contact with the cartridge piercer 18 point it is stopped, because more pressure is required to pierce through the cartridge 12 seal than the spring 21 possesses at this compression stage. Therefore, the force is transferred to another spring 21. When all pressures are equal, each piercer 18 point comes in contact with the cartridge 12 seals. At this stage, when the piercing knob 16 is pushed further the $CO_2$ cartridges 12 are pierced. In case one or two springs 21 collapse at different rates or strengths, a small flat area on the piercer 18 will increase the amount of pressure required to pierce the cartridge 12 seals. In this manner, the seals can be pierced simultaneously. The center pierce bushing enables two $CO_2$ cartridges 12 to be pierced in any event. By adding more center pierce bushings 36, the number of gas cartridges 12 the gun 10 can use can be increased, provided the gas chamber tube 14 is lengthened. The center piece bushing 36 with piercers 18 are formed by turning the bushing 36 and piercers 18 as one piece or, as shown in FIG. 11, by drillinq holes 60 into the center of each side of the bushing and inserting the piercers 18 into the holes 60. The springs 21 are of sufficient diameter to fit over the smaller diameter portion 62 of the bushing 30 and rest against the larger diameter portion 64 of the bushing 36.

Obviously, numerous (additional) modifications and variations of the present invention are possible in light of the above teachings. It is therefore to be understood that within the scope of the appended claims, the invention may be practiced otherwise than as specifically described herein.

I claim:

1. A fully automatic gas operated gun for shooting projectiles comprising:

a means for holding projectiles in series;

a barrel having rifling therein and connected to the projectile holding means such that projectiles can pass from the projectile holding means to the barrel;

a sealed gas chamber tube with at least one $CO_2$ cartridge disposed therein for pressurization, with a gas port hole which runs from the gas chamber tube to the projectile holding means and which supplies pressure to the projectile holding means when a trigger is pulled and an element for piercing the $CO_2$ cartridge being disposed in the gas chamber tube so as to pressurize the gas chamber tube;

a spring for biasing, said spring located within said holding means for forcing any projectile in the holding means to be pushed toward the barrel, but with a spring constant such that the spring is not able to supply enough force to the projectile about to be fired to push the projectile past the rifling into the barrel;

a gas check valve and ram located in the holding means and between the spring and any projectile to be fired, said gas check valve and ram being positioned by the spring at the location where the gas port hole is fluidically connected to the holding means when no projectiles remain in the holding means to be fired. said gas check valve and ram being of sufficient diameter so it is capable of slowing pressures from passing between the holding means and barrel when it is so positioned;

said trigger connected to the gas chamber tube in such a way that when the trigger is pulled pressure in the gas chamber tube is capable of passing into the projectile holding means forcing the projectiles just before the barrel into and through the barrel; and a ramrod for pushing a projectile through the barrel into the projectile holding means.

2. A gun as described in claim 1 including a tubular housing surrounding the projectile holding means, means for sealingly and releasably fixing the tubular housing to a tubular member, and wherein the projectile holding means has a projectile loading hole through which projectiles are loaded into the projectile holding means;

a longitudinal slot hole extending from a position between the gas port hole and the spring to a position past the projectile loading hole. a first pin located on the gas check valve and ram between the gas port hole and the spring, said first pin extending out of the projectile holding means through the longitudinal slot hole; and a check valve notch for receiving the first pin when it is pulled to the notch along the slot in order to bring the spring behind the projectile loading hole so projectiles can be placed into the projectile holding means and be disposed between the spring and the barrel, said notch communicating with the slot at a position behind the projectile loading hole.

3. A gun as described in claim 2 wherein the fixing means includes a second pin extending from the tubular member at a position between the gas port hole and the first pin, and the tubular housing has a grab notch that is disposed at a position to receive the second pin, said grab notch shaped such that when the second pin is fitted into the grab notch and the grab notch is turned, the tubular housing become sealingly secured to the tubular member.

4. A gun as described in claim 2 wherein the fixing means includes a screwed portion integrally connected to the tubular member and disposed between the gas port hole and the first pin, and wherein the tubular housing includes a screw receptor portion at a position such that when the screw receptor portion is screwed onto the screwed portion of the tubular member, the tubular housing is sealingly fixed to the tubular member.

5. A rapid fire gas powered gun for shooting projectiles comprising:

a tubular member comprised of:

a means for holding projectiles in series; and a barrel having rifling therein and connected to the projectile holding means such that projectiles can pass from the projectile holding means to the barrel;

a sealed gas chamber tube with at least one $CO_2$ cartridge disposed therein for pressuriziation, with a gas port hole which runs from the gas chamber tube to the projectile holding means and which supplies pressure to the projectile holding means when a trigger is pulled and an element for piercing the $CO_2$ cartridge being disposed in the gas chamber tube so as to pressurize the gas chamber tube;

a spring for biasing, said spring located within said holding means and forcing any projectile in the holding means to be pushed toward the barrel, but with a spring constant such that the spring is not able to supply enough force to the projectile about to be fired to push the projectile past the rifling into the barrel;

a gas check valve and ram located in the holding means and between the spring and any projectile to be fired, said gas check valve and ram being positioned by the spring at the location where the gas port hole is fluidically connected to the holding means when no projectiles remain in the holding means to be fired, said gas check valve and ram being of sufficient diameter so it is capable of slowing pressure from passing between the holding means and barrel when it is so positioned;

said trigger connected to the gas chamber tube in such a way that when the trigger is pulled pressure in the gas chamber tube is capable of passing into the projectile holding means of the tubular member forcing the projectiles to be fired out of the tubular member through the barrel; and a ramrod for pushing a projectile through the barrel into the projectile holding means.

6. A gun as described in claim 5 including a tubular housing surrounding the projectile holding means, means for sealingly and releasably fixing the tubular housing to a tubular member, and wherein the projectile holding means has a projectile loading hole through which projectiles are loaded into the projectile holding means;

a longitudinal slot hole extending from a position between the gas port hole and the spring to a position past the projectile loading hole. a first pin located on the gas check valve and ram between the gas port hole and the spring, said first pin extending out of the projectile holding means through the longitudinal slot hole; and a check valve notch for receiving the first pin when it is pulled to the notch along the slot in order to bring the spring behind the projectile loading hole so projectiles can be placed into the projectile holding means and be disposed between the spring and the barrel, said notch communicating with the slot at a position behind the projectile loading hole.

7. A gun as described in claim 6 wherein the fixing means includes a second pin extending from the tubular member at a position between the gas port hole and the first pin, and the tubular housing has a grab notch that is disposed at a position to receive the second pin, said grab notch shaped such that when the second pin is fitted into the grab notch and the grab notch is turned, the tubular housing becomes sealingly secured to the tubular member.

8. A gun as described in claim 6 wherein the fixing means includes a screwed portion integrally connected to the tubular member and disposed between the gas port hole and the first pin, and wherein the tubular housing includes a screw receptor portion at a position such that when the screw receptor portion is screwed onto the screwed portion of the tubular member, the tubular housing is sealingly fixed to the tubular member.

9. A rapid fire gas operated gun for shooting projectiles comprising:

a means for holding projectiles in series, said holding means having a diameter;

a barrel having rifling therein and connected to the projectile holding means having a diameter smaller than the diameter of the projectile holding means but at least as large as the diameter of the projectile to be fired, so that projectiles to be fired stop before the barrel because of its smaller diameter but are able to pass out of the barrel when pressure is applied to the projectiles;

a sealed gas chamber tube with at least one $CO_2$ cartridge disposed therein being fluidically connected to the projectile holding means before the barrel at about a length of a projectile to be fired in order to the gas chamber tube to be capable of applying pressure therein only to a projectile about to be fired;

a gas port hole which runs from the gas chamber tube to the projectile holding means and which supplies pressure to the projectile holding means when a trigger is pulled and an element for piercing the $CO_2$ cartridge being disposed in the gas chamber tube so as to pressurize the gas chamber tube;

a spring for biasing, said spring located within said holding means and forcing any projectile in the holding means to be pushed toward the barrel, but with a spring constant such that the spring is not able to supply enough force to the projectile about to be fired to push the projectile past the rifling into the barrel;

a gas check valve and ram located in the holding means and between the spring and any projectile to be fired, said gas check valve and ram being positioned by the spring at the location where the gas chamber tube is fluidically connected to the holding means when no projectiles remain in the holding means to be fired, said gas valve check and ram being of sufficient diameter so it is capable of slowing pressure from passing between the holding means and barrel when it is so positioned;

said trigger connected to the gas chamber tube in such a way that when the trigger is pulled pressure in the gas chamber tube is capable of passing into the projectile holding means forcing the projectiles just before the barrel into and through the barrel and a ramrod for pushing a projectile through the barrel into the projectile holding means.

10. A gun as described in claim 9 including a tubular housing surrounding the projectile holding means, means for sealingly and releasably fixing the tubular housing to a tubular member, and wherein the projectile holding means has a projectile loading hole through which projectiles are loaded into the projectile holding means;

a longitudinal slot hole extending from a position between the gas port hole and the spring to a position past the projectile loading hole, a first pin located on the gas check valve and ram between the gas port hole and the spring, said first pin extending out of the projectile holding means through the longitudinal slot hole; and a check valve notch for receiving the first pin when it is pulled to the notch along the slot in order to bring the spring behind the projectile loading hole so projectiles can be placed into the projectile holding means and be disposed between the spring and the barrel, said notch communicating with the slot at a position behind the projectile loading hole.

11. A gun as described in claim 10 wherein the fixing means includes a second pin extending from the tubular member at a position between the gas port hole and the first pin, and the tubular housing has a grab notch that is disposed at a position to receive the second pin, said grab notch shaped such that when the second pin is fitted into the grab notch and the grab notch is turned, the tubular housing becomes sealingly secured to the tubular member.

12. A gun as described in claim 10 wherein the fixing means includes a screwed portion integrally connected to the tubular member and disposed between the gas port hole and the first pin, and wherein the tubular housing includes a screw receptor portion at a position such that when the screw receptor portion is screwed onto the screwed portion of the tubular member, the tubular housing is sealingly fixed to the tubular member.

* * * * *